US009896816B2

(12) United States Patent
Karsten

(10) Patent No.: US 9,896,816 B2
(45) Date of Patent: Feb. 20, 2018

(54) METHOD AND APPARATUS FOR STABILISING A DIKE

(71) Applicant: J.F. KARSTEN BEHEER B.V., Middelie (NL)

(72) Inventor: Johannes Franciscus Karsten, Middelie (NL)

(73) Assignee: J.F. Karsten Beheer B.V., Middelie (NL)

( * ) Notice: Subject to any disclaimer, the term of this patent is extended or adjusted under 35 U.S.C. 154(b) by 0 days.

(21) Appl. No.: 15/035,781

(22) PCT Filed: Nov. 11, 2014

(86) PCT No.: PCT/NL2014/050778
§ 371 (c)(1),
(2) Date: May 11, 2016

(87) PCT Pub. No.: WO2015/072850
PCT Pub. Date: May 21, 2015

(65) Prior Publication Data

US 2016/0265183 A1 Sep. 15, 2016

(30) Foreign Application Priority Data

Nov. 12, 2013 (NL) ..... 2011788

(51) Int. Cl.
*E02D 5/80* (2006.01)
*E02D 17/20* (2006.01)

(52) U.S. Cl.
CPC ..... *E02D 5/80* (2013.01); *E02D 17/20* (2013.01); *E02D 17/207* (2013.01); *E02D 2300/0006* (2013.01); *E02D 2300/0026* (2013.01); *E02D 2300/0045* (2013.01); *E02D 2300/0081* (2013.01); *E02D 2600/40* (2013.01)

(58) Field of Classification Search
CPC ..... E02D 17/20; E02D 5/80; E02D 5/803; E02B 3/10
USPC ..... 405/259.1
See application file for complete search history.

(56) References Cited

U.S. PATENT DOCUMENTS 722,778 A * 3/1903 Wantling ..... E02D 5/80 52/155
2,349,110 A * 5/1944 Potstada ..... A01G 9/124 47/47
3,579,908 A * 5/1971 Morgan ..... A01G 17/06 239/208

(Continued)

FOREIGN PATENT DOCUMENTS

DE 10 2005 019168 A1 10/2006
GB 2 212 196 A 7/1989
WO WO 2012134263 A1 * 10/2012 ..... E02D 5/803

OTHER PUBLICATIONS

International Search Report, dated Jan. 26, 2015, from corresponding PCT application.

*Primary Examiner* — Tara Mayo-Pinnock
(74) *Attorney, Agent, or Firm* — NLO N.V.; Catherine A. Shultz

(57) ABSTRACT

A ground plug for stabilizing a dike, includes a plug front end suitable for being driven into a dike, and an elongate plug body, wherein the plug body is provided with a pressure distributing member arranged to prevent earth flow in a direction perpendicular to a length direction of the plug, and the plug front end includes a recess for receiving a drive member.

16 Claims, 5 Drawing Sheets

(56) References Cited

U.S. PATENT DOCUMENTS

| | | | | | |
|---|---|---|---|---|---|
| 3,727,357 | A * | 4/1973 | Stillman, Jr. | E04H 12/2215 | 248/156 |
| 4,052,827 | A * | 10/1977 | Yancey | E02D 5/80 | 52/156 |
| 4,269,010 | A * | 5/1981 | Glass | E02D 5/80 | 52/154 |
| 4,574,539 | A * | 3/1986 | Deike | E02D 5/803 | 52/163 |
| 4,802,317 | A * | 2/1989 | Chandler | E02D 5/803 | 52/163 |
| 4,850,565 | A * | 7/1989 | Moreno | E01F 9/685 | 248/156 |
| D346,036 | S * | 4/1994 | Garber | D25/126 | |
| D359,570 | S * | 6/1995 | Garber | D25/126 | |
| 5,649,788 | A * | 7/1997 | Jewett | E02D 5/80 | 175/19 |
| 5,661,932 | A * | 9/1997 | Barefield | E02D 5/80 | 52/154 |
| 5,775,037 | A * | 7/1998 | James | E02D 5/74 | 256/DIG. 5 |
| 5,815,993 | A * | 10/1998 | Castola | E02D 5/803 | 52/163 |
| 5,899,030 | A * | 5/1999 | Barefield | E02D 5/80 | 403/374.1 |
| 6,237,289 | B1 * | 5/2001 | Jewett | E02D 5/803 | 405/259.1 |
| 7,713,003 | B2 * | 5/2010 | Agg | E02D 5/74 | 405/259.1 |
| 7,789,594 | B2 * | 9/2010 | Stahm | E02D 17/20 | 405/302.4 |
| 2013/0212974 | A1 * | 8/2013 | Sullivan | E02D 17/20 | 52/659 |

* cited by examiner

METHOD AND APPARATUS FOR STABILISING A DIKE

BACKGROUND OF THE INVENTION

The present invention relates to a method of stabilizing an earth body such as an embankment or dike and, in particular, to a ground plug for performing the method.

Dikes and embankments have been extensively used for millennia for various purposes, including water retention, road construction and the like. In the following, reference to dikes is intended to cover raised earth bodies in the broadest sense, including dikes, embankments, dams, levies and the like and is not intended to be limiting to sea and river defences. Depending on the local soil conditions, various techniques have been used to construct and stabilize such earth bodies. In particular, dikes made of peat and/or clay and similar material are difficult to stabilize without additional support. Dikes, especially those comprising a core of turf-like material tend to compact and expand depending on the weather conditions. After elongated periods of rain or drought or in the case of raised water level in, under and behind the dike, migration of earth material can occur, resulting in weakening of the dike. A characteristic of most such constructions is the tendency for shear to occur within the dike body. Any weight on an upper portion of the dike tends to bear downwards, tending to subsidence if no action or provision is taken to prevent this. This is particularly problematic in the case that new construction is required on top of or against the dike or if the dike is to be increased in height.

Previous procedures for stabilizing existing dikes have involved the introduction of anchors through the dike and into the stable earth layers there below. These anchors have then been grouted into place using a cement or concrete construction. A disadvantage of such an approach is that the dike becomes more rigid and is unable to swell and contract with the climate without relative movement occurring between the concrete and the core of the dike. Other procedures have involved the formation of concrete and steel dam constructions, vertically into the ground beneath. Although this may lead to a strong and stable structure, it comes at significant expense and the result is to all intents and purposes a retaining wall rather than a traditional dike.

It is also known to apply rotation screws in an existing dike to stabilize the dike. These screws need to rotate when introduced into the dike. This is also referred to with "soil screwing technique". Examples of this technique are found in GB2212196A and DE102005019168A1. Such a soil screw can be combined with a grout to secure the screw even more, like in DE102005019168A1.

It would be desirable to provide a device that can be used for stabilizing of dikes in a cost effective manner.

BRIEF SUMMARY OF THE INVENTION

According to the invention there is provided a ground plug for stabilizing a dike, comprising a plug front end suitable for being driven into a dike, and an elongate plug body, wherein said plug body is provided with a pressure distributing member arranged to prevent earth flow in a direction (a) perpendicular to a length direction of the plug, and in that the plug front end comprise a recess for receiving a drive member. The recess being part of the plug front end enables that the plug is subjected to tensile force upon introducing the plug into a dike. This allows the plug to be flexible such that the plug flexes upon shear within the dike.

The flexibility of the plug would hinder applying a driving force at the tail-end of the plug for driving the plug into the dike. By providing the plug body with a pressure distributing member, flow of earth in a direction perpendicular to the tensile member may be reduced or prevented.

In contrast to existing anchor arrangement that can only be subjected to tensile forces, according to the invention flow loading of the tensile member occurs, preventing lateral flow of earth material within the dike that could lead to subsidence. The pressure distributing member acts as a flow restricting means and distributes the forces acting in different earth layers. In dike bodies it has been observed that depending on the water level in, under or behind the dike and also the constitution of the dike material it is possible that on different levels different lateral forces may act. The same may apply in relation to changes in loading on the dike.

If an earth body such as a dike would only be stabilized by "clamping" the earth material between a ground anchor and a counter member, lateral migration of earth which can be promoted by water resulting in a flowable slurry, cannot be prevented. According to the invention such lateral flow can be considerably reduced.

It should also be understood that flow of earth material can be in a non-horizontal plane. This depends on the build-up of the different layers of the dike and the way in which the dike is subjected to water and draining of such water.

It is important to note that a ground plug enters the dike in a sliding motion. No rotation of the ground plug is required or even possible when introducing the plug into the dike. Such a plug can be pushed or pulled into the ground, if desired with the aid of hammering, drilling or vibrating means. It will be apparent that in contrast, known soil screws are screwed into the dike, which screwing relaxes the ground which is undesirable. A soil screw cannot enter a dike in sliding motion.

According to a preferred embodiment, the pressure distributing member is elongated and extends along the plug, preferably over at least 50% of its length, more preferably over at least 80% of its length, even more preferably over the entire length of the plug body. In this manner, the plug will maintain its position within the dike along its longitudinal axis because of the friction between the pressure distributing members and the dike. No additional means are required for maintaining the position of the plug within the dike along its longitudinal axis. The length of the ground plug and its pressure distributing members help determine the friction between the pressure distributing member and the dike. This friction between the pressure distributing member and the dike is then a determining factor in the main function of the pressure distributing member, that is to prevent earth flow in a direction (a) perpendicular to a length direction of the plug. It will be understood that a plurality of pressure distribution members may be provided on a single plug body e.g. spanning different zones of possible slip. The location of these zones may be determined by geotechnical surveys of the dike.

The pressure distributing member can be embodied in several ways in order to optimize its function to restrict displacement of earth material. Preferably the pressure distributing member has a relatively large surface to be as effective as possible. Preferably the pressure distribution member has a width or diameter of at least 5 cm, more preferably at least 10 cm and most preferably at least 15 cm.

According to one preferred embodiment, the pressure distributing member is embodied as a bladed structure. According to another preferable embodiment the pressure distributing member may be integral with the plug body. According to another preferable embodiment the plug body is integral with the plug front end. It is possible to use one and the same material for both the pressure distributing member, the plug body, and the plug front end. For the pressure distributing member, such materials may include metals, preferably corrosion resistant or treated metals, composite materials including fibre and/or basaltic composites, ceramic materials, plastics, like vinyl, and the like. A particularly suitable material is basalt epoxy composite, as this is not subject to corrosion.

The ground plug may have any required length for insertion through the dike to the required anchor location. Most preferably the ground plug will have a minimum length of about 2 m. Actual length of the ground plug may be up to even 30 m and longer. The plug may have any required diameter like between 20 cm to 40 cm. It may comprise any of the materials mentioned above, subject to adequate tensile strength. One particularly suitable material is based on a basalt fibre composite material.

According to one preferred embodiment, the plug comprises a cavity which extends along the longitudinal axis of the plug and adjoins the recess and is configured for introducing a drive member there through. In this manner, no voids are left in the dike after installation of the plug into the dike because the drive member is able to contact the recess in the plug front end through cavity. Such undesirably voids in a dike may cause a dike to cave of erode since water tends to flow through such a void. In particular the cavity is centrally-arranged with respect to the plug.

The invention also relates to an assembly of a ground plug according to the invention and a pivotable ground anchor that can be inserted into the dike by the drive member, wherein the pivotable ground anchor is coupled with the plug front end and the plug front is open for coupling the drive member with the pivotable ground anchor. In this manner one may take advantage of the ability of the ground anchor to be driven into the ground. The plug front being open may create an unwanted channel through the plug which may require filling of the plug with a filler like grout or anything similar. The ground anchor is coupled with the plug in such a way that the pivotable ground anchor maintains its ground introducing position upon driving the plug into the dike. It will be appreciated that ground anchors are well known in the art and used for many purposes.

The invention also relates to an dike comprising a number of adjacently arranged ground plugs, arranged to prevent earth flow in a direction perpendicular to the length direction of said plug. Through the use of a number of ground plugs having pressure distributing members a possible flow path for earth material can be effectively blocked. It will be appreciated that such ground plugs may be inserted in any direction through the dike, including vertically and horizontally and from any angle from a front side or rear side of the dike. In an embodiment, a plug tail-end is provided near an outer surface of the dike.

The invention also relates to a method for stabilizing a dike using a ground plug according to the invention, the method comprising:

connecting a drive member to a plug front end;

introducing the plug through the dike and at least partly into a stable layer beneath the dike; and arranging the pressure distributing member at a position within the dike where stabilisation against lateral earth movement is required.

In this context, a stable layer is intended to denote a layer that is not subject to lateral slip and that is adequate for providing the required tension force. This layer may be the underlying clay layer beneath the dike or a stable core, not subject to slip.

In an embodiment, the method for stabilizing a dike comprises performing a geotechnical survey of the dike and positioning the pressure distributing member at a position corresponding to a slip zone within the dike.

The invention will be further elucidated referring to preferred embodiments shown in the drawing in which.

Figure 2:
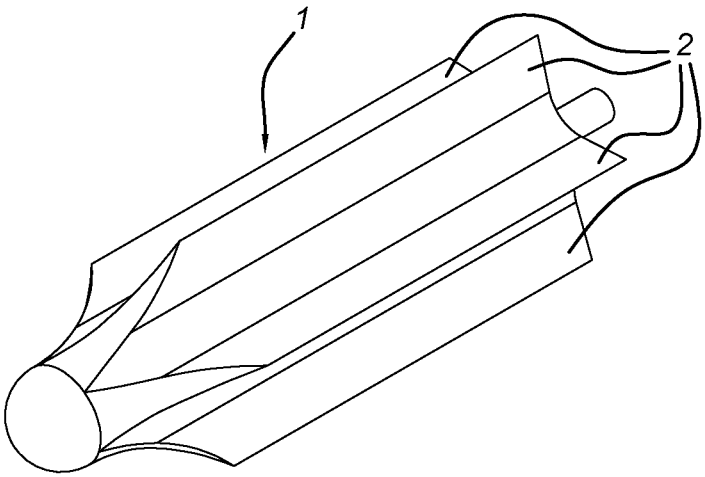
FIG. 2 is perspective front view of a ground plug according to the invention.
Figure 3:
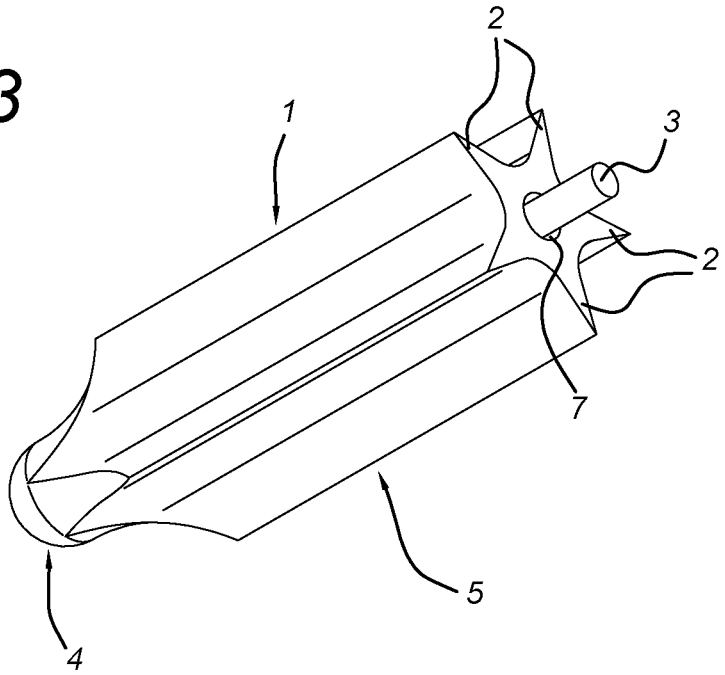
FIG. 3 is a perspective rear view of the ground plug of FIG. 2.
Figure 5A:
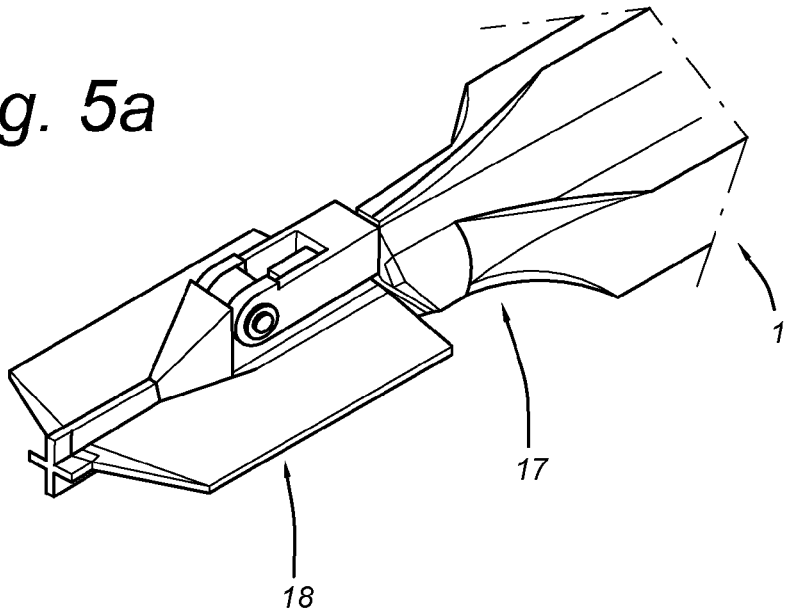
Figure 5B:
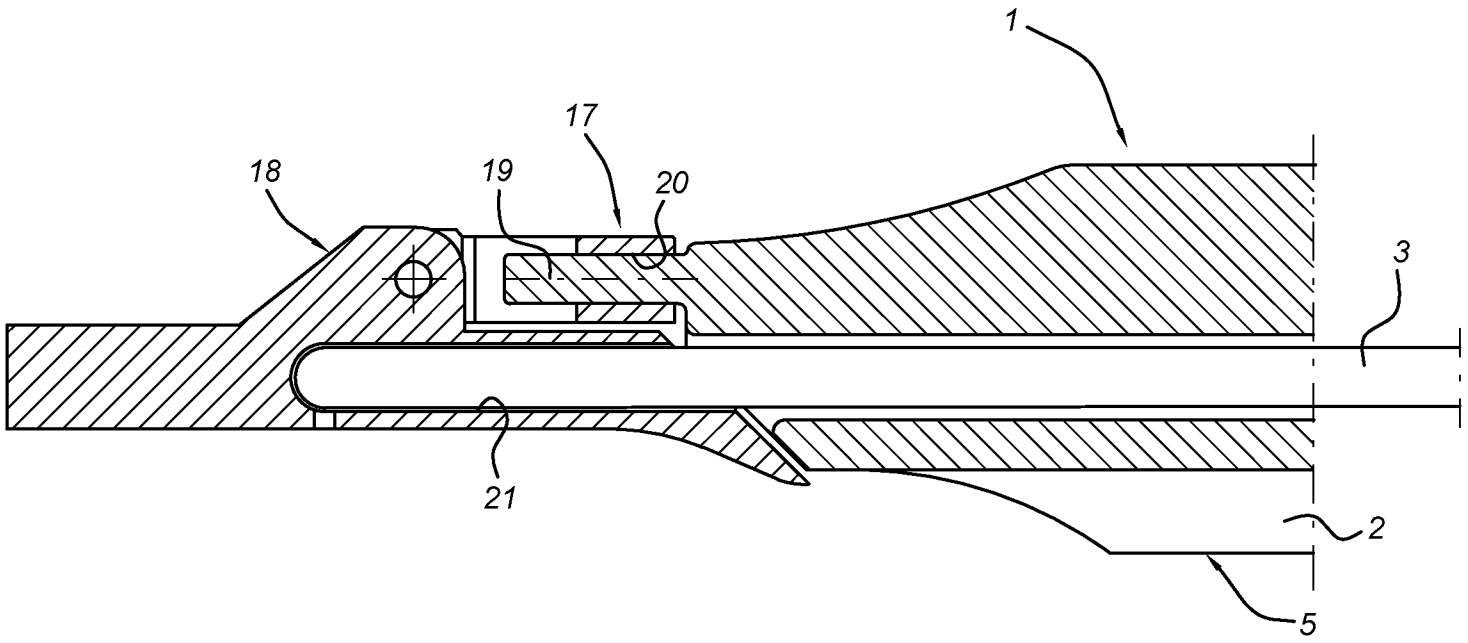

FIG. 4*a-d* show respectively a side, front, rear and cross sectional side view of the ground plug of FIG. 2;

FIG. 5*a* shows a perspective view of an assembly of a pivotable ground anchor and a ground plug according to the invention: and FIG. 5*b* shows a cross sectional side view of the assembly of FIG. 5*a*.

Figure 1:
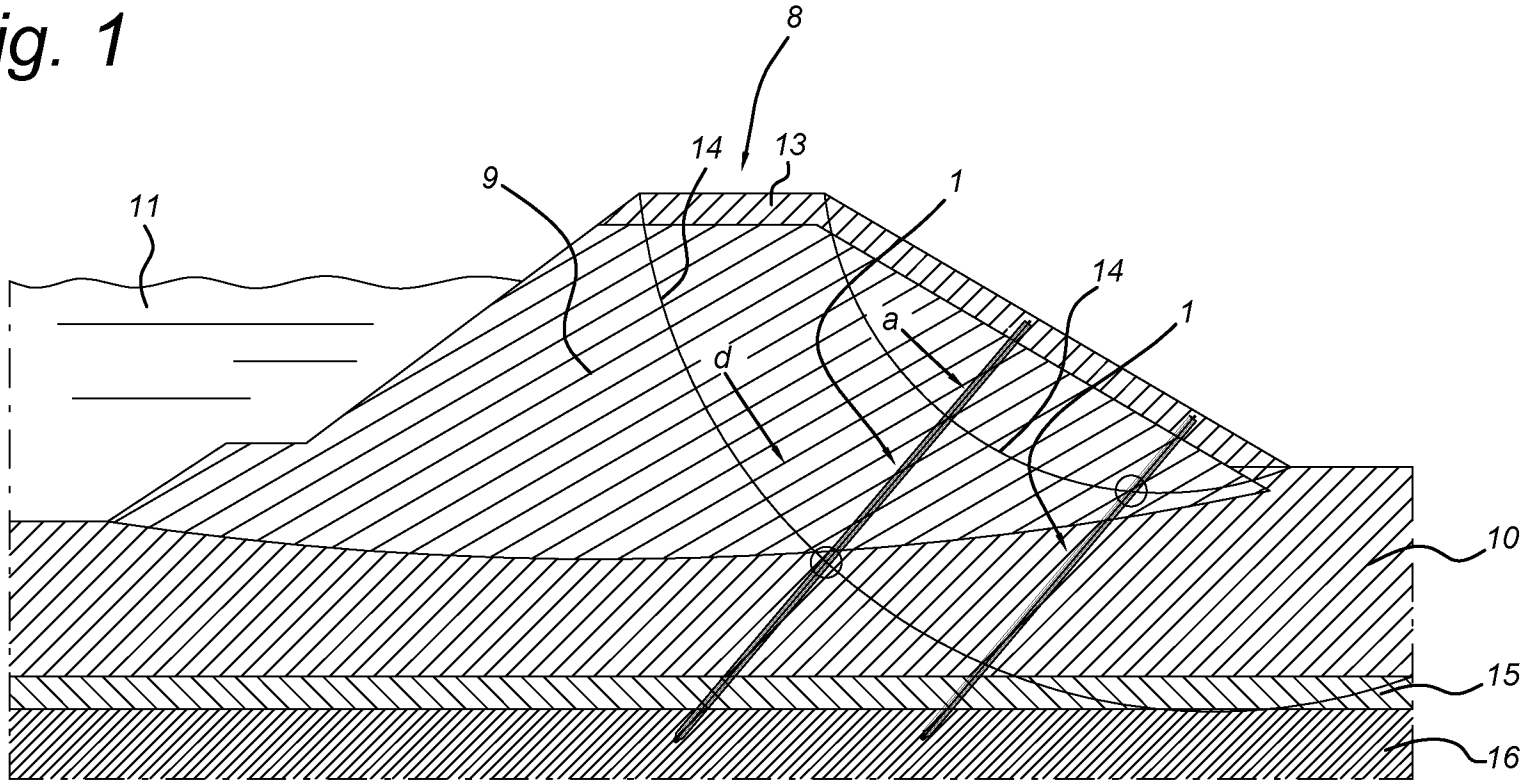
FIG. 1 is a cross section through a dike according to the invention.

A dike 8 is shown in FIG. 1. The dike 8 is arranged above the original soil layer 10 and comprises an earth core 9. One side of the dike 8 is subjected to pressure from water 11 whilst the other side thereof should remain dry.

By placing a number of ground plugs 1 as shown in FIG. 2 adjacent to each other in length direction, the position of the earth core 9 is fixed in normal conditions.

Due to rain or other particular circumstances it might normally be possible that the moisture content in the dike 8 becomes so high that flow of earth material is possible resulting in removal of earth material. However, according to the invention by using pressure distributing member 2, movement of earth is substantially prevented. By placing a number of ground plugs 1 adjacent to each other occurrence of a flow of earth material is blocked.

In FIG. 1, arrow a shows a flow direction perpendicular to the plug 1. It should be understood that other flows, for example horizontal flows, are also prevented.

The dike 8 has a top surface 13 and earth core 9. In this embodiment, 14 shows possible slip lines. Portions of the dike can slide with respect to each other under unfavourable circumstances in the direction of arrows d along these slip lines 14. The location of these slip lines 14 or planes can be determined through geotechnical surveying of the dike 8. Through the presence of the ground plug 1 according to the invention and more particular the pressure distributing members 2 such migration can be effectively prevented. In the FIG. 1 the ground plug 1 is located such as to span a respective slip line 14, even two slip lines 14. Here, the plug extends through the surface layer 13, the ground core 9, the original soil layer 10 which may be stable, and stable layers 15, 16 beneath the soil layer 10.

In FIG. 2-4*d* a ground plug 1 according to the invention is generally shown at 1. The substantial entire plug body 5 is provided with a pressure distributing member 2. The pressure distributing member 2 is elongated and extends along the plug 1, over the entire length of the plug body 5. The pressure distributing member 2 has a bladed structure, having a star in cross-section as shown in FIGS. 4*b* and 4*c*. The plug has a plug diameter 22 of, here, 25 cm. The plug pressure distributing member 2 then has a width, or better height transverse with respect to the longitudinal axis 12, of 5 cm.

Figure 4A:
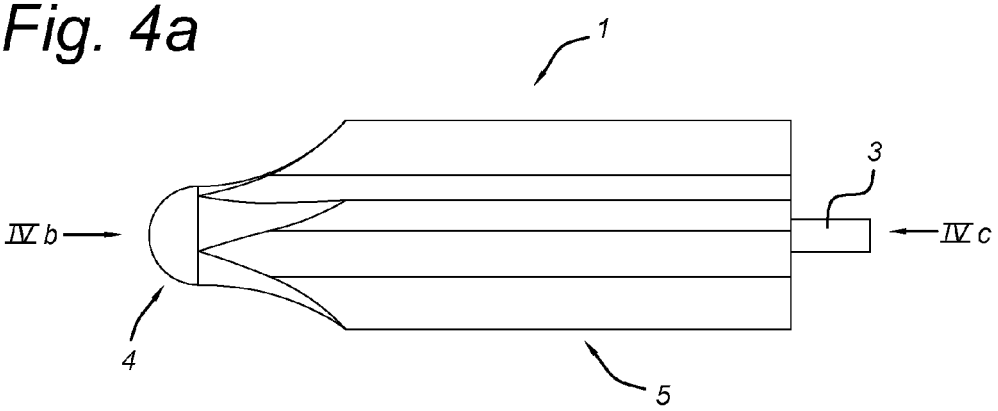
Figure 4B:
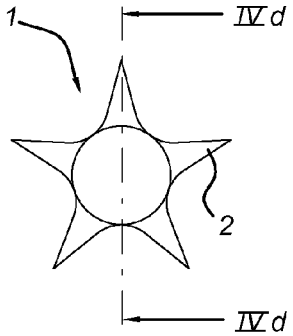
Figure 4C:
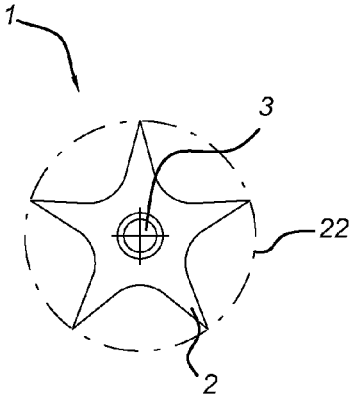
Figure 4D:
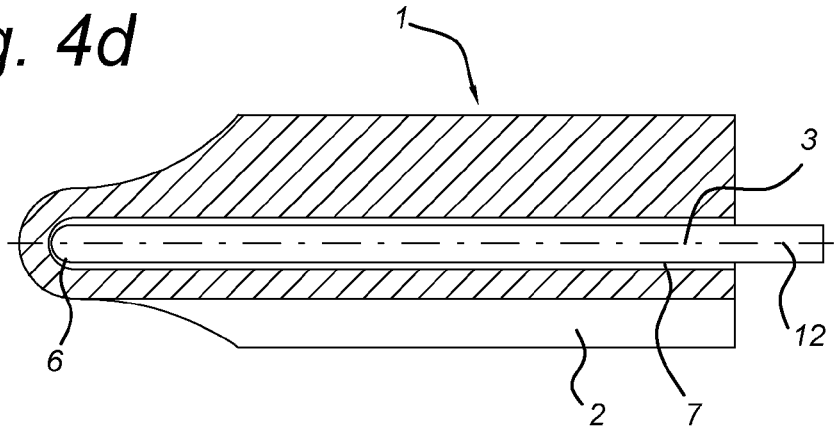

The plug front end 4 has a reduced frontal area compared with the plug body 5 such that the plug 1 may be introduced into the dike 8 more easily. The driving member 3 may be a rod or a similar means. The plug front end 4 comprise a recess 6 for receiving the driving member 3. The plug body 5 is provided with a centrally arranged cavity 7 which extends along the longitudinal axis 12 of the plug 1. The cavity 7 adjoins the recess 6 of the plug front end 4 and is configured for introducing the drive member 3 there through. As best shown in FIG. 4*d*, the driving member 3 extends through the cavity 7 and ends in the recess 6 upon driving the pug 1 into a dike 8. It is also possible to introduce a hardening or non-hardening stabilizing material into the cavity 7 after introduction of the plug 1 into the dike 8.

In FIGS. 3*b* and 3*c* the pressure distributing member 2 is shown as having a star shape in cross-section. Other shapes are conceivable like in the form of a strip. or in the form of a three bladed shape. It will be understood that these shapes are merely exemplary and that any other suitable cross-section may be provided that increases the surface area for the prevention of lateral flow. The pressure distributing member 2 may also be spiralled along the length of the plug 2. It is also possible that the shape of the pressure distributing member 2 is not the same over the length of the plug 21 but might vary according to the requirements set which depend from the constitution of the several ground layers and the probability of lateral movement.

FIG. 5*a* en 5*b* show an assembly 17 of a ground plug 1 and a pivotable ground anchor 18 that can be inserted into the dike by the drive member 3. The pivotable ground anchor 18 is coupled with the plug front end and the plug front is open as shown for coupling the drive member 3 with the pivotable ground anchor 18. Therefore the anchor 18 is provided with a driving recess 21 as is known for these anchors 18 per se. The ground anchor 18 is coupled with the plug 1 in such a way that the pivotable ground anchor maintains its ground introducing position upon driving the plug into the dike 8. Therefore the plug front end is provided with a plug cam 19 which mates with a positioning recess 20 of the anchor 18.

It should be realized that the above are only examples of the invention. Furthermore it should be clear that combinations can be made with other techniques resulting in further effectiveness of stabilization.

Starting from this disclosure, many more embodiments will be evident to a skilled person, which are within the scope of protection and the essence of this invention and which are obvious combinations of prior art techniques and disclosure of this invention.

The invention claimed is:

1. A ground plug for stabilizing a dike, comprising a plug front end suitable for being driven into a dike, and an elongate plug body of at least two meters, wherein said plug body is provided with a pressure distributing member arranged to prevent earth flow in a direction perpendicular to a length direction of the plug, and the plug front end comprises a recess with a closed front end for receiving a drive member such that the plug is subjected to tensile force upon introducing the plug into a dike, wherein the plug is flexible such that the plug flexes upon shear within the dike, and wherein the recess extends to the closed front end of the plug.

2. The ground plug according to claim 1, wherein the pressure distributing member is elongated and extends along the plug over at least 50% of its length.

3. The ground plug of claim 2, wherein the pressure distributing member is elongated and extends along the plug over at least 80% of its length.

4. The ground plug according to claim 1, wherein the pressure distributing member comprises a bladed structure, having a star in cross-section.

5. The ground plug according to claim 1, wherein the pressure distributing member is integral with the plug body.

6. The ground plug according to claim 1, wherein the plug comprises a cavity which extends along the longitudinal axis of the plug and adjoins the recess and is configured for introducing a drive member there through.

7. The ground plug according to claim 6, wherein the cavity is centrally-arranged with respect to the plug.

8. The ground plug according to claim 1, wherein the plug body is integral with the plug front end.

9. Ground plug according to claim 1, wherein the pressure distributing member comprises a composite material.

10. The ground plug of claim 9, wherein the composite material comprises basalt epoxy composite.

11. The ground plug of claim 9, wherein the composite material comprises at least one of metals, corrosion resistant material, a treated metal, fibre composites, ceramic materials, plastics and vinyl.

12. An assembly of a ground plug according to claim 1 and a pivotable ground anchor that can be inserted into the dike by the drive member, wherein the pivotable ground anchor is coupled with the plug front end and the plug front is open for coupling the drive member with the pivotable ground anchor.

13. A dike comprising a plurality of adjacently arranged ground plugs according to claim 1, arranged to prevent earth flow in a direction (a) perpendicular to the length direction of the plug.

14. The dike according to claim 13, wherein a plug tail-end is provided near an outer surface of the dike.

15. A method for stabilizing a dike using a ground plug with a plug front end comprising a closed end, an elongate body of at least two meters and a pressure distributing member extending along the elongate body, the method comprising:

connecting a drive member to a plug front end such that the drive member contacts the closed end at the plug front end;

introducing the plug through the dike and at least partly into a stable layer beneath the dike; and arranging the pressure distributing member at a position within the dike where stabilization against lateral earth movement is required, wherein the plug is flexible such that the plug flexes upon shear within the dike.

16. The method according to claim 15, further comprising performing a geotechnical survey of the dike and positioning the pressure distributing member at a position corresponding to a slip zone within the dike.

* * * * *